US008233834B2

(12) United States Patent
Horrall et al.

(10) Patent No.: US 8,233,834 B2
(45) Date of Patent: Jul. 31, 2012

(54) RAKE MECHANISM FOR DISTRIBUTING WASTE TONER IN A PRINTER

(75) Inventors: Paul Douglas Horrall, Lexington, KY (US); Peyman Kermanshani Nejad, Lexington, KY (US); Christopher Kent Washing, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 708 days.

(21) Appl. No.: 12/199,025

(22) Filed: Aug. 27, 2008

(65) Prior Publication Data

US 2010/0054832 A1 Mar. 4, 2010

(51) Int. Cl.
*G03G 21/00* (2006.01)

(52) U.S. Cl. ..... 399/358; 399/35; 399/120

(58) Field of Classification Search ..... 399/358, 399/35, 99, 120, 359
See application file for complete search history.

(56) References Cited

U.S. PATENT DOCUMENTS

| | | | | |
|---|---|---|---|---|
| 5,583,625 | A | 12/1996 | Kondoh | |
| 5,907,752 | A | 5/1999 | Kondoh | |
| 6,701,113 | B2 | 3/2004 | Matsuda et al. | |
| 7,085,507 | B2 | 8/2006 | Cook et al. | |
| 7,107,002 | B2 * | 9/2006 | Saito et al. | 399/360 |
| 7,280,776 | B2 | 10/2007 | Cook et al. | |
| 2004/0146326 | A1 * | 7/2004 | Ahn et al. | 399/358 |
| 2005/0163545 | A1 | 7/2005 | Cook et al. | |

* cited by examiner

*Primary Examiner* — David Gray
*Assistant Examiner* — Roy Y Yi

(57) ABSTRACT

The present invention provides a waste particulate toner collection container system for an image forming apparatus that includes a waste particulate toner spreading device movably disposed within the container in a reciprocating manner generally along its length, the device including a spine member having on a first end a first plurality of spaced apart raking tine members and on a second end a second plurality of spaced apart raking tine members disposed substantially transversely of the length of the spine member, and a crank arm attached at the first end of the spine member. A post disposed on an inner wall of the container supports the device at a point along the length of the spine member between the first and second pluralities of raking tine members, and a drive mechanism is operatively connected to the crank arm for imparting reciprocating movement to the device.

22 Claims, 2 Drawing Sheets

RAKE MECHANISM FOR DISTRIBUTING WASTE TONER IN A PRINTER

BACKGROUND

1. Field of the Invention

The present invention relates generally to an image forming apparatus, and more particularly to an improved rake mechanism for a waste toner collection system in an image forming apparatus.

2. Description of the Related Art

Image forming apparatus, such as electrophotographic (EP) printers or copiers, typically use particulate developer material (toner) in the imaging operations. Such machines form output images by depositing toner onto a charged roller or other photosensitive member according to a latent print image and then running that toner to a media sheet.

Some amount of residual toner remains on the photosensitive member after image transfer and requires removal, such as by bringing a cleaning blade or other scraping mechanism into contact with the photosensitive member. The waste toner thus removed may be collected within a container included in the image forming apparatus. Potentially significant amounts of waste toner may be collected over time, particularly in machines that include multiple process cartridges, each of which acts as a source of waste toner.

In U.S. Pat. No. 7,280,776 to Cook et al, an image forming apparatus is described that includes a waste toner system that collects waste toner in a waste toner container. An amount of waste toner collected in the container is increased by using a driven toner distributing member (rake) that distributes accumulated toner within the container. The waste toner system may detect the accumulation of waste toner by monitoring a drive control circuit while the toner distributing member is being driven. For example, the system may detect excess accumulation by comparing the monitored values of a frequency control signal with one or more reference values corresponding to nominal accumulation conditions. An extension may be employed whereby movement of the toner distributing member creates interference between the toner distributing member and the container when the toner distributing member reaches a predetermined position. The interference may be detectable from the drive control circuit as an indication of a full condition. The entire contents and teachings of the Cook et al patent are incorporated by reference herein.

SUMMARY OF THE INVENTION

The present invention provides a waste particulate toner collection container system for an image forming apparatus that includes a waste particulate toner spreading device movably disposed within the container in a reciprocating manner generally along its length, the device including a spine member having on a first end a first plurality of spaced apart raking tine members and on a second end a second plurality of spaced apart raking tine members disposed substantially transversely of the length of the spine member, and a crank arm attached at the first end of the spine member. A post disposed on an inner wall of the container supports the device at a point along the length of the spine member between the first and second pluralities of raking tine members, and a drive mechanism is operatively connected to the crank arm for imparting reciprocating movement to the device.

Accordingly, in an aspect of the present invention, a waste particulate toner collection system for an image forming apparatus is described that includes:

a container for receiving waste particulate toner from an image forming apparatus, the container including means defining at least one inlet opening for receiving waste particulate toner from the image forming apparatus;

a waste particulate toner spreading device movably disposed within the container, the device having a first end and a second end and being movable in a reciprocating manner in a direction generally along the length of the device for spreading waste particulate toner within the container, the device including, a spine member extending along the length of the device from the first end to the second end, a first plurality of spaced apart raking tine members disposed on the spine member near the first end of the device and substantially transversely of the length of the spine member, and a second plurality of spaced apart raking tine members disposed on the spine member near the second end of the device and substantially transversely of the length of the spine member, and a crank arm attached at the first end of the device;

a post disposed on an inner wall of the container for supporting the device at a point along the length of the spine member between the first plurality of raking tine members and the second plurality of raking tine members; and a drive mechanism attached to the crank arm for imparting reciprocating movement to the device substantially along the length thereof.

In another aspect of the present invention, a device for spreading toner within a waste particulate toner container, is described that includes:

a member movably disposed within the container, the member being movable in a reciprocating manner in a direction generally along the length of the member;

a first plurality of spaced apart raking tines disposed on the member near a first end thereof and substantially transversely of the length of the member, and a second plurality of spaced apart raking tines disposed on the member near a second end thereof and substantially transversely of the length of the member;

a crank arm attached to the first end of the member;

a post disposed on an inner wall of the waste particulate toner container for supporting the member at a point along the length of the member between the first plurality of raking tines and the second plurality of raking tines; and a drive mechanism attached to the crank arm for imparting reciprocating movement to the member substantially along the length thereof.

In a further aspect of the present invention, an improvement in an image forming apparatus having a container for receiving waste particulate toner from the image forming process members of the image forming apparatus is described that includes:

a waste particulate toner spreading device movably disposed within the container, the device having a first end and a second end and being movable in a reciprocating manner in a direction generally along the length of the device for spreading waste particulate toner within the container, the device including, a spine member extending along the length of the device from the first end to the second end, a first plurality of spaced apart raking tine members disposed on the spine member near the first end of the device and substantially transversely of the length of the spine member, and a second plurality of spaced apart raking tine members disposed on the spine member near the second end of the device and substantially transversely of the length of the spine member, and a crank arm attached to the first end of the device;

a post disposed on an inner wall of the container for supporting the device at a point along the length of the spine member between the first plurality of raking tine members and the second plurality of raking tine members; and a drive mechanism attached to the crank arm for imparting reciprocating movement to the device substantially along the length thereof.

The invention therefore provides a waste particulate toner collection distribution system wherein distribution of the toner along the length of the waste toner container is accomplished so that waste toner does not accumulate in the middle or sides of the container and thereby allows maximum use of the container volume. A separate power source for operating the system is not required, in that the rake mechanism of the invention is powered by the motorized source that powers the image forming apparatus.

BRIEF DESCRIPTION OF THE DRAWINGS

Figure 1:
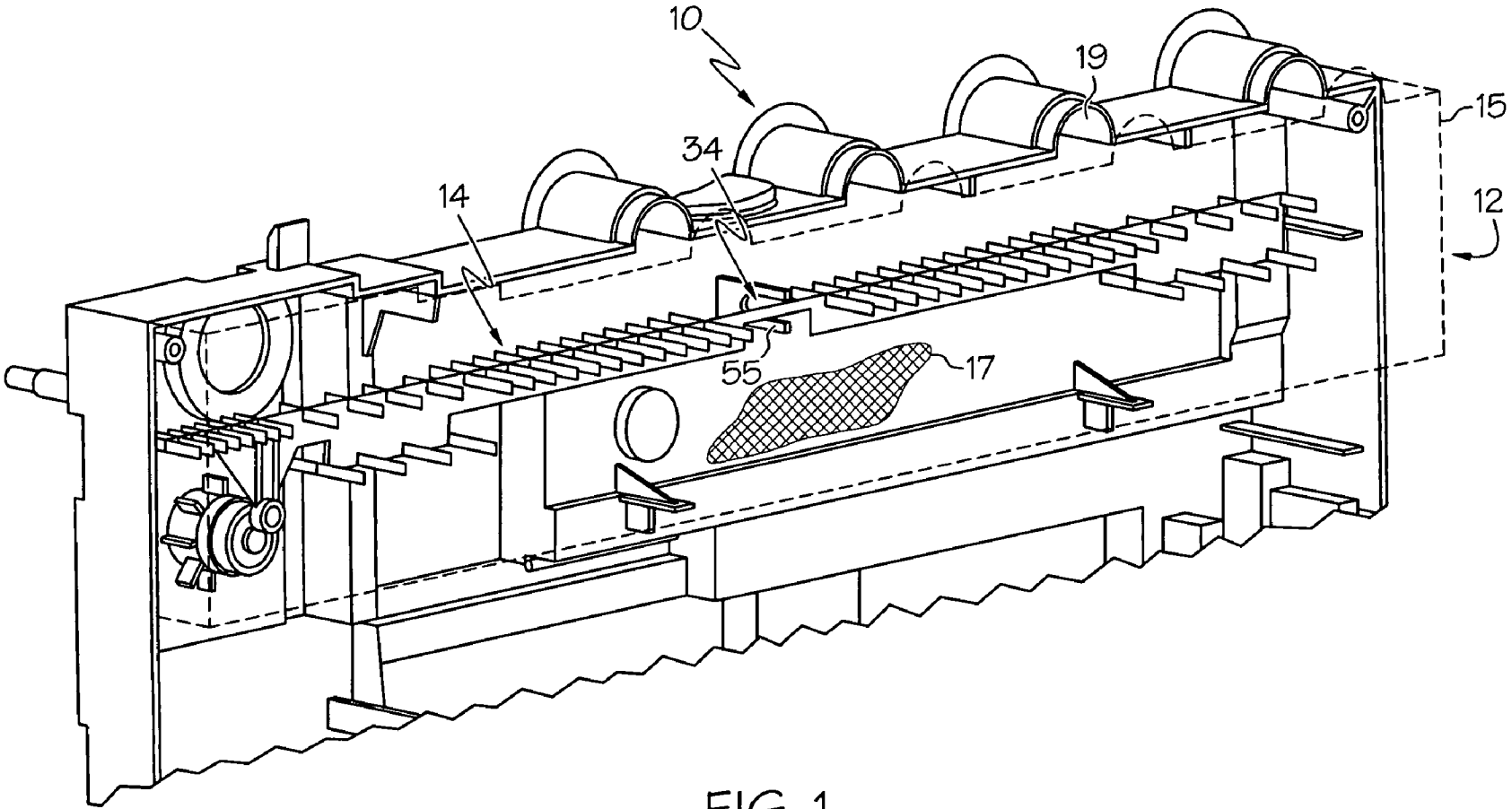

Having thus described the invention in general terms, reference will now be made to the accompanying drawings, which are not necessarily drawn to scale, and wherein:

FIG. 1 is a perspective view of one side of an exemplary image forming apparatus showing the location of a representative embodiment of the toner distributing member (hereinafter "toner rake") of the present invention within the image forming apparatus.

Figure 2:
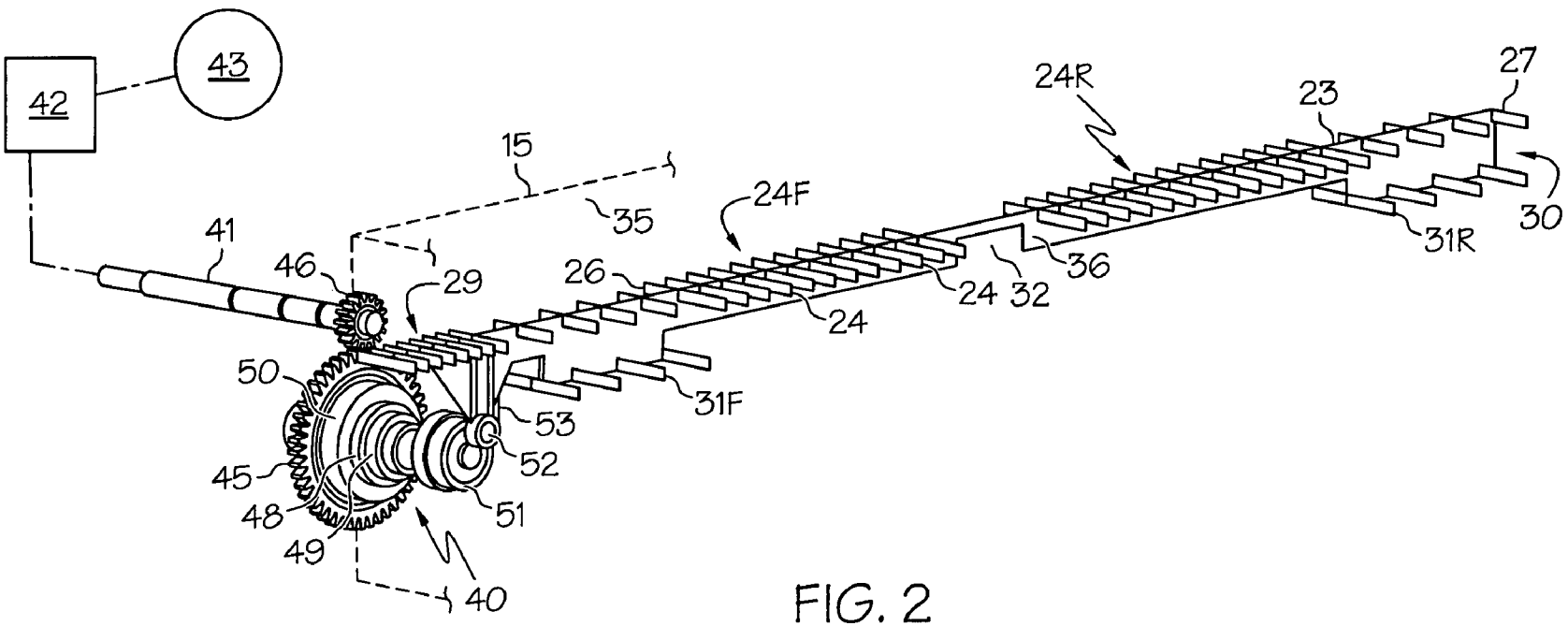

FIG. 2 is a perspective view of one embodiment of a toner rake according to the present invention, operatively attached to a drive apparatus within the image forming apparatus.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

FIG. 1 is a perspective view of one side of an exemplary image forming apparatus 10 (hereinafter, "apparatus 10") showing the location of a representative embodiment of the toner rake 14 of the present invention within the apparatus 10.

Regardless of its specific implementation details, apparatus 10 typically uses a consumable developer material, such as in the form of particulate toner, to form desired images on media sheets processed by it. Thus, image forming apparatus 10 may be a laser printer, copier, facsimile, etc. During imaging operations, apparatus 10 forms desired images, e.g., text, graphics, etc., by transferring the particulate developer material (toner) from one or more image transfer members, such as rotating photoconductive drums, to copy sheets or other media being fed through apparatus 10. Residual toner is scoured or otherwise cleaned from the image transfer members of apparatus 10 between image forming operations to maintain the requisite print quality. The residual toner, broadly referred to herein as "waste toner", is collected in a controlled fashion within a waste toner container forming a part of apparatus 10.

Accordingly, and with reference now specifically to FIG. 1, shown therein is a perspective view of a portion of apparatus 10 including selected details of an exemplary waste toner collection system 12 that is configured to accumulate waste toner generated during the imaging operations for apparatus 10. In the non-limiting example shown, the toner rake 14 comprising a principal aspect of the invention herein is disposed within a toner collection container 15 that forms an element of waste toner collection system 12. Toner collection container 15 typically includes means for removable attachment to apparatus 10 for receiving and retaining waste toner 17 produced as a result of imaging forming operations of apparatus 10. The waste toner 17 is inserted into toner container 15 through one or more inlet openings 19 in the housing comprising container 15 and accumulated within container 15 as suggested in FIG. 1. During imaging operations, residual waste toner 17 removed from one or more image forming and transfer members (not shown) of apparatus 10 is conveyed into waste toner container 15 by any suitable mechanism, such as that described in Cook et al.

In operation, waste toner 17 accumulates within container 15 to the extent that at some point container 15 must be removed and emptied or replaced. Periodic removal and emptying of container 15 represents an ongoing point of service for apparatus 10, so it is desirable to fully use the capacity of container 15 by accumulating as much waste toner 17 as possible within container 15 before requiring its removal or replacement.

In accordance then with an aspect of the invention herein, toner rake 14 is disposed within waste toner container 15 in order to spread toner accumulating in container 15 to make efficient use of the volumetric capacity of container 15. Toner rake 14 according to one aspect of the invention may then comprise the structure depicted most clearly in FIG. 2 as including one or more longitudinally extending spine members 23 supporting a plurality of closely spaced generally transversely disposed raking tine members 24, each raking tine member 24 generally including a forwardly facing raking surface 26 and a rearwardly facing raking surface 27. It should be noted at the outset that in accordance with the various aspects of the invention, toner rake 14 may be of any convenient size (length and width) as would conveniently reside within container 15 and operate therewithin as hereinafter described. Typically, rake 14 has an overall nominal length of about 11.7 inches and a nominal width of about 0.8 inch. In one exemplary embodiment, tine members comprise substantially flat members about 0.42 to 0.8 inch long by about 0.04 inch nominal width and spaced apart about 0.4 inch on spine 23. Further, although the raking tine members 24 are shown in the figures as being disposed on spine member(s) 23 substantially perpendicularly transverse to the spine members, it is understood that the raking tine members 24 may, within the scope of these teachings and of the appended claims, be disposed at any selected angle to the lengthwise dimension of spine members 23, and, further, selected raking tine members 24 at the forward end 29 of rake 14 may be disposed at an angle different from that of the raking tine members comprising the rearward end 30 of rake 14, and individual raking tine members within each respective plurality may be disposed differently than others, all as would occur to the skilled artisan practicing the invention and guided by these teachings, in order to optimize the spreading of waste toner 17 within container 15, in both the lengthwise direction and side-to-side direction within container 15.

Toner rake 14 may comprise any suitable material of construction as would occur to the skilled artisan practicing the invention guided by these teachings, including molded (including injection molded) plastic, ABS plastic (acrylonitrile butadiene styrene) or other lightweight material, the same not considered limiting of the invention or of the appended claims.

One or both ends 29 and 30 of rake 14 may include a second tier of raking tine members 31F or 31R in order to enhance toner 17 distribution, especially below the point where black waste toner is inserted into container 15.

In order to accomplish spreading of waste toner 17 within container 15, a reciprocating motion is imparted to toner rake 14 during operation of apparatus 10. As waste toner is inserted into container 15, movement of rake 14 interacts with any toner 17 pile that accumulates near inlet opening(s) 19 to accomplish the desired spreading and to prevent excessively uneven waste toner 17 buildup within container 15, particularly near the inlet opening(s).

Reference is now made specifically to FIG. 2. According to one aspect of the invention, the reciprocating motion can be imparted to rake 14 by connection to a drive mechanism 40 geared to a back-up roller 41 forming an element of the image forming process members 42 of apparatus 10 (process members shown only schematically and not in detail in the figures) . Motor 43 drives the image forming process members of apparatus 10 including back-up roller 41. In the exemplary embodiment shown in FIG. 2, drive mechanism 40 includes a rotatable gear 45 geared to and driven by a mating gear 46 on back-up roller 41. Power is transmitted through the pair of gears 45 and 46 that in one example had a 3:1 gear ratio. Gear 45 is operatively connected to and drives coupler 49 that is located on waste toner container 15. Coupler 49 rotates inside a bearing 48 which is sealed by a rubber lip 50. Coupler 49 is operatively connected to and drives crank 51 having an off-center pin 52. Forward end 29 of rake 14 includes crank arm 53 attached to and supported by pin 52. Crank arm 53 is depicted in the figures as being generally perpendicular to the lengthwise dimension of spine member 23. It should be noted, however, that crank arm 53 can be disposed substantially in line with or at any angle to spine member 23, within the intended scope of these teachings and of the appended claims. Accordingly, rotation of crank 51 imparts a reciprocating motion to rake 14 generally in the lengthwise direction thereof. Additionally, a vertical (as FIG. 2 is viewed) up-and-down motion is imparted to forward end 29 of rake 14 by the rotation of crank 51. The extent of the up-and-down movement of rake 14 forward end 29 is measured by twice the offset radius distance of pin 52 on crank 51. In the aforementioned exemplary embodiment, the speed of backup roller 41 was about 150 rpm which translates through the 3:1 gear ratio of gears 45 and 46 to 50 rpm speed for crank 51. Translational movement of rake 14 imparted along its length was about 0.22 inch.

In accordance with a feature of the invention, the structure of rake 14 includes a gap 32 (typically about 1.063 inches in width) between a first plurality of raking tine members 24F disposed generally toward the forward end 29 of rake 14, and a second plurality of raking tine members 24R disposed generally toward the rearward end 30 of rake 14. A pivot post 34 (see FIG. 1) attached to the inner surface 35 of container 15 provides a second point of support for rake 14 within container 15. Gap 32 can be located anywhere along the length of rake 14 although the location shown in FIG. 2 results in sufficient pivoting motion of rake 14 to enhance the degree of spreading of waste toner 17. Post 34 is therefore located on surface 35 at a point corresponding to the locus of gap 32 along the length of rake 14. A rectangular shaped guide 36 may be included at gap 32 in order to limit side-to-side movement of rake 14 on post 34.

In operation, the power transmitted from motor 43 to drive mechanism 40 results in back-and-forth (longitudinal) movement of rake 14 along a direction substantially corresponding to the length of the rake. The longitudinal motion of rake 14 is combined with a rocking motion of rake 14 about post 34 which enhances the toner spreading action of rake 14. Post 34 may have a bump shape feature 55 to impart a vibratory motion to rake 14 as it slides across post 34.

Although the waste toner spreading function of rake 14 during operations of apparatus 10 results in substantially maximum utilization of the volumetric capacity of container 15, container 15 will eventually fill up after which no additional toner should be collected in it. In Cook et al, which is incorporated by reference herein, a description is presented of a system that detects the full condition of the waste toner container that may be useful in conjunction with the practice of the present invention to prevent further image forming operations if the container requires emptying or replacement. Overfilling the waste toner container is thereby avoided and possible contamination of the image forming apparatus with waste toner is avoided.

The present invention may be practiced in ways other than as specifically set forth herein without departing from the scope and essential characteristics of the invention. The description of several embodiments of the invention as herein presented is therefore intended for purposes of illustration. It is not intended to be exhaustive or to limit the invention to the precise forms disclosed, and obviously many modifications and variations are possible in light of the above teachings. It is intended that the scope of the invention be defined by the claims appended hereto.

We claim:

1. A waste particulate toner collection system for an image forming apparatus, comprising:

(a) a container for receiving waste particulate toner from an image forming apparatus, said container including means defining at least one inlet opening for receiving waste particulate toner from said image forming apparatus;

(b) a waste particulate toner spreading device movably disposed within said container, said device having a first end and a second end and being movable in a reciprocating manner in a direction generally along the length of said device for spreading waste particulate toner within said container, said device including:

(i) a spine member extending along the length of said device from said first end to said second end, (ii) a first plurality of spaced apart raking tine members disposed on said spine member near said first end of said device and substantially transversely of said length of said spine member, and a second plurality of spaced apart raking tine members disposed on said spine member near said second end of said device and substantially transversely of said length of said spine member, said second plurality of spaced apart tine members separated from said first plurality of spaced apart tine members by a gap, and (iii) a crank arm attached at said first end of said device, said crank arm being movable such that movement of said crank arm imparts reciprocating movement to said device substantially along said length thereof; and (c) a post disposed on an inner wall of said container for pivotably supporting said device at a point along the length of said spine member within said gap between said first plurality of raking tine members and said second plurality of raking tine members.

2. The system of claim 1 wherein said waste particulate toner spreading device is disposed substantially horizontally within said container.

3. The system of claim 1 further comprising a drive mechanism coupled to said crank arm for imparting reciprocating movement to said waste particulate toner spreading device.

4. The system of claim 1 wherein said waste particulate toner spreading device is constructed of a plastic or ABS.

5. The system of claim 1 wherein a motor that drives said image forming process members of said image forming apparatus is operatively connected to said waste particulate toner spreading device for imparting reciprocating movement to said waste particulate toner spreading device.

6. The system of claim 1 further comprising a plurality of spaced apart raking tine members disposed on said spine member on at least one of said first and second ends of said device opposite said respective said first and second pluralities of said raking tine members.

7. A device for spreading toner within a waste particulate toner container, comprising:

(a) a member movably disposed within said container, said member being movable in a reciprocating manner in a direction generally along the-length of said member;

(b) a first plurality of spaced apart raking tines disposed on said member near a first end thereof and substantially transversely of the length of said member, and a second plurality of spaced apart raking tines disposed on said member near a second end thereof and substantially transversely of said length of said member, said second plurality of spaced apart tine members separated from said first plurality of spaced apart tine members by a gap;

(c) a crank arm attached to said first end of said member, said crank arm being movable such that movement of said crank arm imparts reciprocating movement to said device substantially along said length thereof; and (d) a post disposed on an inner wall of said container for pivotably supporting said device at a point along the length of said spine member within said gap between said first plurality of raking tine members and said second plurality of raking tine members.

8. The device of claim 7 wherein said member is disposed substantially horizontally within said container.

9. The device of claim 7 further comprising a drive mechanism for imparting reciprocating movement to said member via said crank arm.

10. The device of claim 7 wherein said member is constructed of a plastic or ABS.

11. The device of claim 7 wherein a motor that drives said image forming process members of said image forming apparatus is operatively connected to said member for imparting reciprocating movement to said member.

12. The device of claim 7 further comprising a plurality of spaced apart raking tines disposed on said member on at least one of said first and second ends of said opposite said respective said first and second pluralities of said raking tines.

13. In an image forming apparatus having a container for receiving waste particulate toner from the image forming process members of the image forming apparatus, a toner movement system, comprising:

(a) a waste particulate toner spreading device movably disposed within said container, said device having a first end and a second end and being movable in a reciprocating manner in a direction generally along the length of said device for spreading waste particulate toner within said container, said device including a spine member extending along said length of said device substantially from said first end to said second end, a first plurality of spaced apart raking tine members disposed on said spine member near said first end of said device and substantially transversely of said length of said spine member, and a second plurality of spaced apart raking tine members disposed on said spine member near said second end of said device and substantially transversely of the said length of said spine member, said second plurality of spaced apart tine members separated from said first plurality of spaced apart tine members by a gap, and a crank arm attached to said first end of said device, said crank arm being movable such that movement of said crank arm imparts reciprocating movement to said device substantially along said length thereof; and (b) a post disposed on an inner wall of said container for pivotably supporting said device at a point along the length of said spine member within said gap between said first plurality of raking tine members and said second plurality of raking tine members.

14. The system of claim 13 wherein said waste particulate toner spreading device is disposed substantially horizontally within said container.

15. The system of claim 13 further comprising a drive mechanism coupled to said crank arm for imparting reciprocating movement to said waste particulate toner spreading device.

16. The system of claim 13 wherein said waste particulate toner spreading device is constructed of a plastic or ABS.

17. The system of claim 13 wherein a motor that drives the image forming process members of said image forming apparatus is operatively connected to said waste particulate toner spreading device for imparting reciprocating movement to said waste particulate toner spreading device.

18. The system of claim 13 further comprising a plurality of spaced apart raking tine members disposed on said spine member on at least one of said first and second ends of said device opposite said respective said first and second pluralities of said raking tine members.

19. The system of claim 1 wherein said post comprises a bump feature for imparting a vibratory motion to said spine member slides across said post.

20. The system of claim 1 wherein said post comprises a bump feature for imparting a vibratory motion to said spine member slides across said post.

21. The device of claim 7, further comprising a bearing sealingly connected to said container, and a coupler disposed within said bearing and operably connected to said crank arm such that rotation of said coupler imparts movement of said crank arm.

22. The device of claim 7, wherein said movement of said crank arm comprises rotation thereof.

* * * * *